United States Patent [19]

Beattie et al.

[11] Patent Number: 4,977,766

[45] Date of Patent: Dec. 18, 1990

[54] UNIVERSAL LOCK MOUNT

[75] Inventors: Patrick J. Beattie, West Henrietta; Andrew L. Oliveri; Richard J. Sylvester, both of Rochester, all of N.Y.

[73] Assignee: John D. Brush & Co., Inc., Rochester, N.Y.

[21] Appl. No.: 459,452

[22] Filed: Jan. 2, 1990

[51] Int. Cl.[5] ..... E05B 15/14

[52] U.S. Cl. ..... 70/326; 70/302

[58] Field of Search ..... 70/323, 326, 327, 328, 70/303 A, 303 R, 302, 329

[56] References Cited

U.S. PATENT DOCUMENTS

| | | | |
|---|---|---|---|
| 105,303 | 9/1870 | Streeter | 70/327 |
| 3,968,667 | 7/1976 | Gartner | 70/303 A |
| 4,376,380 | 3/1983 | Burgess | 70/329 |
| 4,512,167 | 4/1985 | Remenicky | 70/329 |

*Primary Examiner*—Robert L. Wolfe

*Attorney, Agent, or Firm*—Eugene Stephens & Associates

[57] ABSTRACT

A universal lock mount for use with a variety of different types of safe locks. It includes an integral resin structure having a bushing portion and a mounting plate portion. The bushing portion supports lock components, and the mount also includes a retaining cap which is fused to the outer end of the bushing portion to hold the components as an independent assembly. Resin spacing washers minimize wear and provide for smoothness and consistency in the movement of the lock assembly components. Use of the mount permits the lock components to be preassembled, tested and adjusted prior to installation so that the resulting assembly functions as an independent lock element. The universal mount also facilitates security of the safe. Because the assembly is independent of the spindle/driver mechanism used to position its components, removal or destruction of the spindle/driver mechanism does not affect the components supported on the universal mount, and the safe remains locked.

18 Claims, 4 Drawing Sheets

UNIVERSAL LOCK MOUNT

BACKGROUND

This invention relates to locks for security enclosures such as safes, strong boxes and the like. Such locks are mounted on the inside of the safes, and they are operated by means of handles or dials which are mounted on the outside of the safes and connected to said locks via spindles extending through the outer and inner walls of the safe and through the insulation therebetween. The spindles are usually fixed to cam drivers which engage and position lock cams that, in turn, cooperate with locking bolt assemblies to prevent the opening of the enclosures until the lock cam is moved to a position permitting the bolt to be moved. The movement of the spindles is controlled by a special key, or by the operation of a combination, or by insertion of a magnetic card, etc.

The components of such locks are supported on a bushing bolted to a mounting plate that attaches to the inner wall of the safe. Usually, the components are assembled at the time the lock is installed in the safe, being received over drive spindles which are mounted through holes in the safe walls to connect the dials or handles on the outside wall of the safe with the lock components mounted on the inner wall. With safes having heavy steel walls, it is not unusual to have slight misalignment problems between the spindle holes in the inner and outer walls. These alignment problems can cause the spindle to be canted in relation to the inner wall, i.e., not perpendicular to the surface of the inner wall; and this in turn makes it difficult to line up a cam driver or drive tumbler (fixed to the spindle) with other lock components fixed to the inner wall. This misalignment can cause tumbler skipping or dragging, can create stiffness in the movement of the lock components, and/or can result in unsatisfactory wear problems.

Further, when combination locks are used, the installer must assemble the components, e.g., tumbler wheels, spacing washers, retaining nuts, etc., with special care to assure that the tumblers, while being readily movable, are not too loose and that the movement of the dial feels smooth and consistent. Since each installer has his or her own sense of smoothness, similar locks from the same manufacturer may feel differently because assembled by different installers. In addition, the movement of such combination locks often loosens with wear and loses this needed smoothness and consistency.

We have developed a universal mounting structure which can be used with many different lock assemblies. The manufacture of locks for safes is simplified and made more economical by using this novel mounting structure. Lock components can be preassembled prior to installation in the safe, and the entire premounted assembly can be easily shimmed during installation to overcome spindle alignment problems. Also, use of this universal mount permits critical lock components, such as the tumbler wheel assemblies of combination locks, to be assembled prior to installation. Therefore, the smoothness and consistency of tumbler wheel assemblies can be tested and adjusted before installation, and the movement of such combination locks can be made uniform and not dependent upon the sensibilities of the installer.

Further, by virtue of this independent assembly feature of our invention, the security of the lock is increased. That is, since the tumbler wheel assembly is independent of the dial/spindle/driver mechanism, if the dial should be broken off and the spindle be punched out, the tumbler wheel assembly remains intact to prevent opening of the safe enclosure.

SUMMARY OF THE INVENTION

Our universal lock mount includes a unitary structure which is made from a strong resin and has a mounting plate portion and a bushing portion. The bushing portion has a cylindrical bearing surface for receiving and supporting lock components, while the mounting plate portion is appropriately configured for cooperating with fasteners used to mount the lock assembly to the wall of a safe. Since all of the components are mounted on this unitary structure, spindle misalignment problems can be solved simply by shimming between the mounting plate portion and the inner safe wall. In this regard, to facilitate such shimming, the preferred embodiments of the unitary structure have mounting plate portions with only three mounting support areas.

The bushing portion has an axial keyway which can be used to prevent rotation of certain components, e.g., spacing washers, mounted thereon. A preferred embodiment has a shoulder at the intersection of the mounting plate and bushing portions and also has a step at the outer end of the bushing portion to receive an end cap for retaining the components mounted thereon.

In conjunction with this unitary structure, preferred embodiments of the universal mount can include one or more keyed spacing washers, a biasing spring in the form of a wave washer, and the end cap just referred to above which can be fused to the stepped outer end of said bushing. Further, for some lock assemblies, a variation of the end cap can be used to extend the bearing surface of the bushing to hold additional or larger components.

The spacing washers are also manufactured from an appropriate resin and are designed with special engagement surfaces to minimize warping, to reduce wear, and to provide a frictional consistency when they coact with moving components which are zinc coated. These washers help to provide a desired smoothness in lock operation.

DRAWINGS

Figure 5:
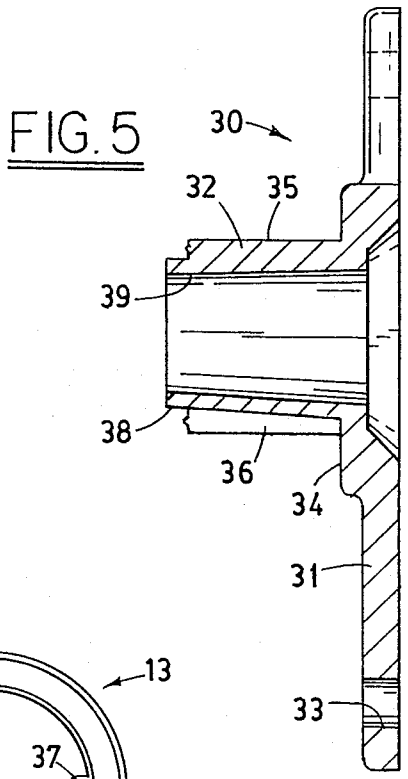
Figure 3:
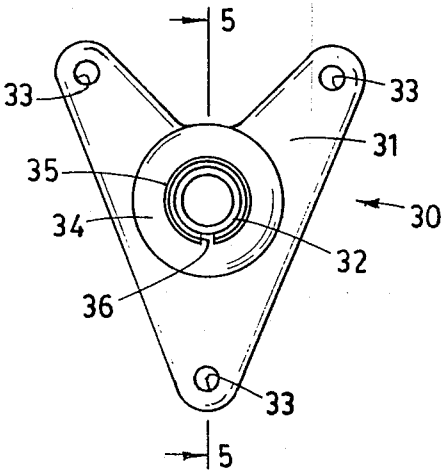
Figure 4:
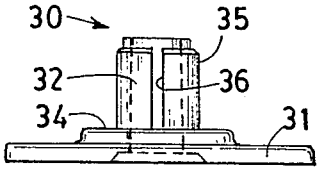

FIGS. 3, 4, and 5 are three views of a preferred embodiment of the unitary mounting plate/bushing structure element of our universal mount, FIG. 5 being a cross section taken along line 5—5 in FIG. 3.

Figure 6:
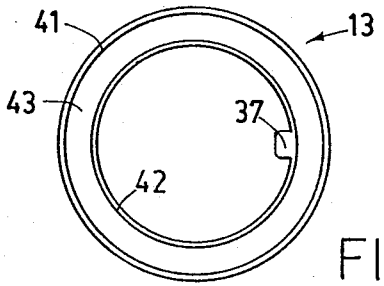

FIG. 6 is plan view of a preferred spacing washer used with our universal mount.

Figure 7:
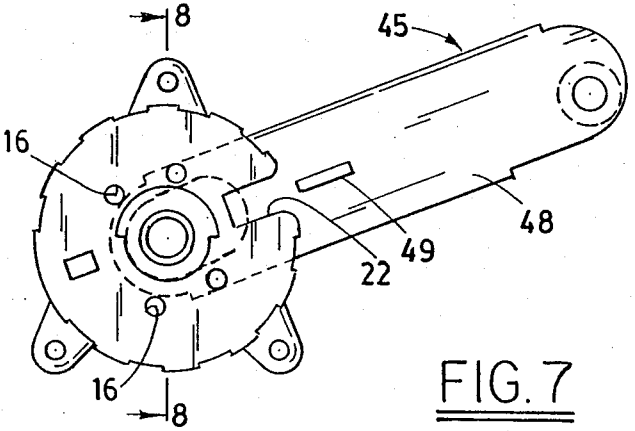
Figure 8:
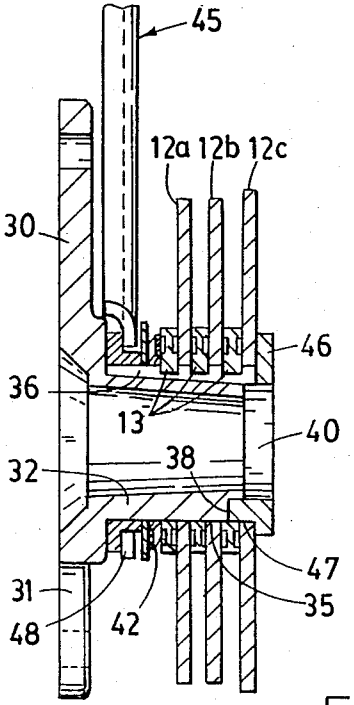

FIGS. 7 and 8 are two views of a combination lock assembly for a hotel safe using another embodiment of our universal lock mount, FIG. 8 being a cross section taken along line 8—8 in FIG. 7.

Figure 10:
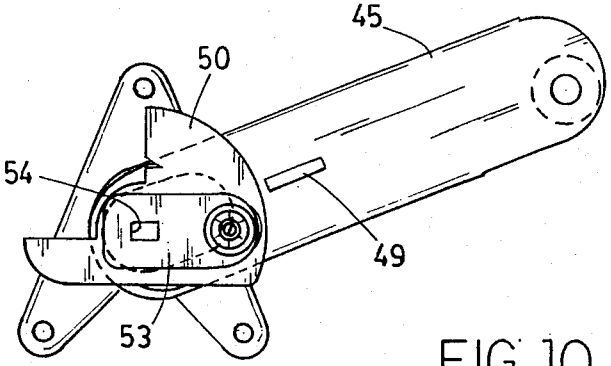
Figure 9:
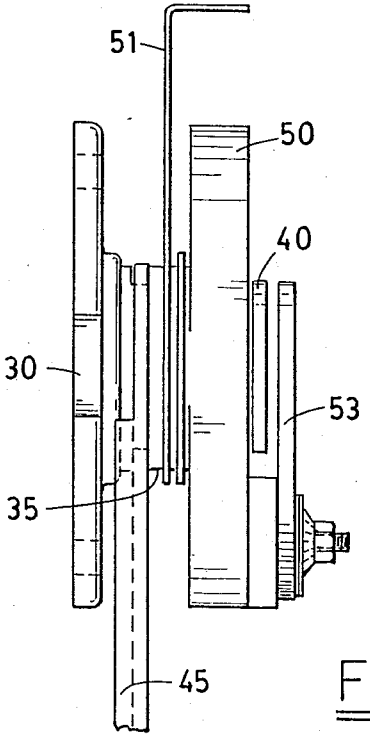

FIGS. 9 and 10 are two views of a magnetic key lock for a hotel safe using still another embodiment of our universal lock mount.

DETAILED DESCRIPTION

Figure 2:
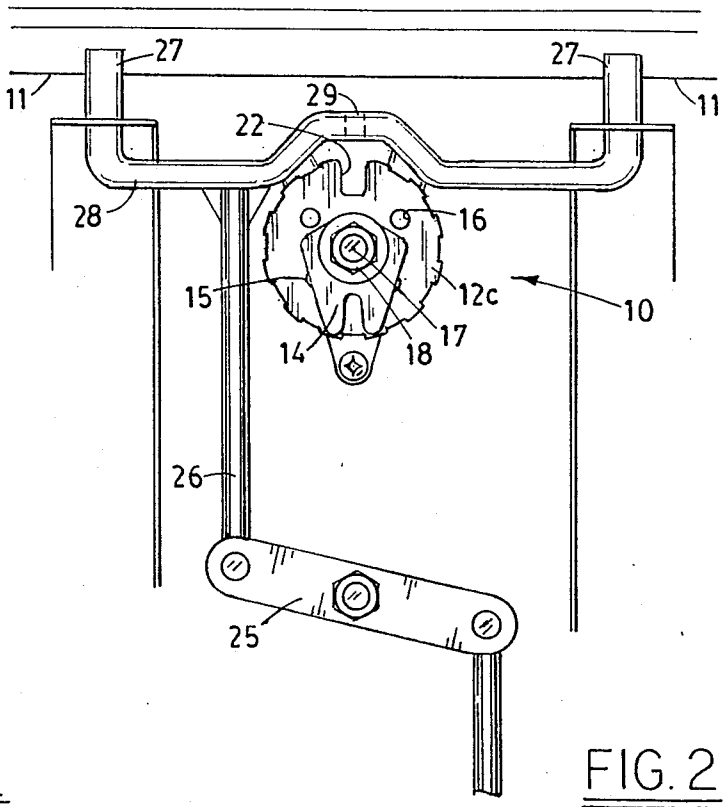
FIG. 2 is a view of the inside of the same safe door shown in FIG. 1 with the door cover removed.
Figure 1:
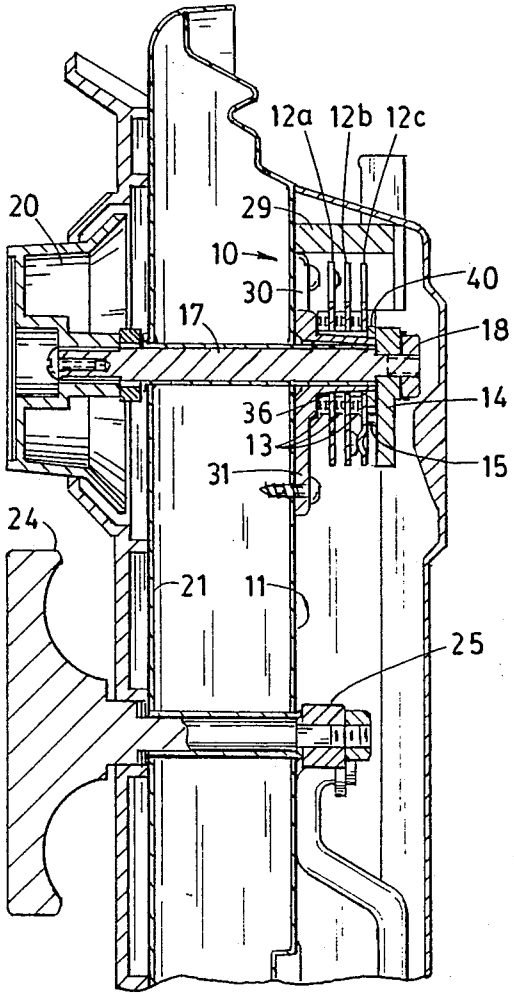
FIG. 1 is a cross-sectional view of a portion of a safe door on which are mounted a combination lock assembly using one embodiment of our universal lock mount, a combination lock dial and spindle, and a live bolt assembly and handle.

Referring to FIGS. 1 and 2, a universal lock mount assembly 10 according to our invention is shown mounted to an inside wall 11 of a safe. Assembly 10 includes three tumbler wheels 12*a*, 12*b*, and 12*c* separated by spacing washers 13. A driver 14 has a driving stud 15 which engages one of several holes 16 angularly spaced in driver tumbler 12*c*.

Driver 14 is splined to spindle 17, being held in place by a nut 18. Spindle 17 is in turn splined to a dial 20 mounted on an outer wall 21 of the safe. In a manner well known in the art, appropriate clockwise and counterclockwise rotation of dial 20 causes a similar rotation of driver 14 to move tumbler wheels 12*a*, 12*b*, and 12*c* until their respective gate notches 22 are all aligned as shown in FIG. 2.

When the gate notches of the tumbler wheels are so aligned, a handle 24, also mounted on outer wall 21, can be turned to open the safe. That is, when handle 24 is turned, it rotates a T-bar 25 which moves a connecting rod 26 to pull out a pair of live bolts 27 carried by a bracket 28. Such movement of live bolts 27 is only possible when gate notches 22 of the tumbler wheels are aligned as shown in FIG. 2 so that they do not block lock projection 29 which is also carried on bracket 28.

Universal lock mount assembly 10 is an independent assembly which is carried by an integral structure 30 shown in detail in FIGS. 3, 4, and 5, the latter figure being a cross section taken along line 5—5 of FIG. 3. Structure 30 is made from a strong resin, e.g., polycarbonate, and has a mounting plate portion 31 and a bushing portion 32. Mounting plate portion 31 is configured to receive fasteners for attaching the assembly to a safe wall. In this preferred embodiment, three holes 33 are provided to receive the hardware used for installing the assembly, and the holes are positioned to facilitate shimming of the assembly if such shimming should be required during installation to conform the assembly to any misalignment of drive spindle 17. Mounting plate portion 31 also has a shoulder 34 that surrounds bushing portion 32.

Bushing portion 32 has a cylindrical bearing surface 35 for supporting the tumbler wheels 12 and washers 13, and it has an axial keyway 36 which cooperates with keys 37 formed in the inner periphery of washers 13 (see FIG. 6). A step 38 forms a pair of orthogonal surfaces in the outer end of bushing portion 32 for receiving and retaining cap 40 which is fused (e.g., dielectrically, ultrasonically, etc.) to both surfaces of step 38 for holding all of the assembly components on the bushing. A lock spindle passageway 39, concentric with cylindrical bearing surface 35, goes completely through integral resin structure 30 and is used to receive the spindles of the drive assemblies which rotate the lock components mounted on bushing portion 32.

To achieve a desired smoothness and consistency of motion for tumbler wheels 12, spacing washers 13 (see FIG. 6) are also molded of a resin material, e.g., a mixture of nylon and molybdenum disulfide; and their wear surfaces are contoured as a pair of concentric engagement surfaces 41 and 42 surrounding a groove 43. With this design, push pins and sprues, required for molding, are relegated to the groove 43, assuring maximum flatness of the wear surfaces; and warping is minimized during the shrinking that occurs following manufacture.

Another preferred embodiment of the universal lock mount is shown in FIGS. 7 and 8, the latter figure being a cross section taken along line 8—8 of FIG. 7. This lock assembly is used in a combination lock for a security enclosure such as a strong box or a hotel room safe. Again, integral resin structure 30 is used to support the various lock assembly components which, in this case again include tumbler wheels 12 and spacing washers 13. These components are mounted on the bearing surface of bushing portion 32, with washers 13 being keyed to axial keyway 36. In addition, a lock link and pin-subassembly 45 is also supported on bushing 32 and is positioned between shoulder 34 of mounting plate portion 31 and the grouped tumbler wheels and washers.

To accommodate this additional subassembly 45, a different retaining cap 40′ is used. Cap 40′ is still fused to the orthogonal surfaces of step 38 at the outer end of bushing 31, but cap 40′ is longer axially, and it has a retaining wall section 46 at is outer end. Retaining cap 40′ also has a cylindrical bearing surface 47 which is coextensive with cylindrical bearing surface 35 of bushing 32 and supports drive tumbler 12*c* and a spacing washer 13. A wave washer 42, mounted between subassembly 45 and the grouped tumbler wheels and washers, biases the latter against retaining wall 46 of cap 40′ and serves to maintain the tumblers and washers in parallel and perpendicular to bearing surface 35 of bushing 32.

A dial/spindle/driver assembly (not shown) similar to that illustrated in FIG. 1 and discussed above, is used to position tumbler wheels 12. When gate notches 22 of tumbler wheels 12 are aligned as shown in FIG. 7 by proper operation of the safe combination, a handle (not shown) is turned to move lock link 48 to the left, and the movement of lock link 48 permits the door of the safe to be opened. Extending perpendicular to the surface of lock link 48 is lock projection 49 which can be moved into the aligned gate notches 22 but which blocks the opening movement of link 48 in the event the gate notches are not so aligned.

FIGS. 9 and 10 show still another lock assembly using our universal lock mount as an element of a magnetic key lock arrangement. In this assembly, a lock cam 50 is biased by a spring 51 to the position shown. Lock link and pin assembly 45 and lock projection 49 must be moved to the left (FIG. 10) by means of a handle (not shown) to open the safe in the manner just described above. This can only be done when lock cam 50 is rotated 90 degrees to align the open notch of cam 50 with lock projection 49. A cam driver 53 is bolted to cam 50 and has a slot 54 for receiving the end of a spindle (not shown) which is turned by a key knob (not shown) on the front of the safe. A magnetic key is inserted into the key knob and is used to turn it, rotating driver 53 and turning cam 50 to the open position just referred to above. (It will be appreciated that the magnetic knob is part of lock apparatus well known in the art and forms no part of the invention being claimed herein.)

The just described lock components are all once again supported on bearing surface 35 of integral resin structure 30. Retaining cap 40 is fused to the stepped outer end of bushing portion 32 (see FIG. 5) to hold the components in position.

All of the lock assemblies described above function as independent elements of the lock systems for which they are designed. That is, each is assembled prior to installation in a safe, each assembly can be tested and adjusted prior to being used, and such adjustment need not be disturbed at the time of installation.

Further, in all of these assemblies, the spindle/driver mechanism that is used to turn the tumbler wheels or lock cam, is received through lock spindle passageway 39 but is not interconnected directly with integral resin structure 30 so that the lock assembly supported thereon remains an independent unit. Therefore, as mentioned above, should the spindle be driven through the lock mechanism, the assembly supported on our universal lock mount remains intact, preventing opening of the safe.

We claim:

1. A universal lock mount for supporting lock components to be assembled prior to installation in a safe or the like, said components including a friction washer and a retaining cap, said universal mount comprising:

an integral resin structure forming a mounting plate portion and a bushing portion having a cylindrical bearing surface with an axial keyway for receiving and supporting said components, and a step formed at its outer end for receiving said retaining cap, said mounting plate portion being configured to receive fasteners for installing said assembled lock components, and said integral structure also having a lock spindle passageway therethrough concentric with said cylindrical bearing surface.

2. The universal lock mount according to claim 1 further comprising a base shoulder surrounding said bushing portion where said bushing portion meets said mounting plate portion.

3. The universal lock mount according to claim 1 wherein said friction washer includes a key for cooperation with said keyway to prevent rotation of said washer when supported on said bushing portion.

4. The universal lock mount according to claim 3 wherein said friction washer is wider radially than axially and radial surfaces of the washer are each formed with a peripheral groove separating two flat annular engagement surfaces.

5. The universal lock mount according to claim 1 wherein said step has radial and axial surfaces and said retaining cap contacts the outer end of said bushing portion along both said surfaces.

6. The universal lock mount according to claim 5 wherein said retaining cap has a raised retaining wall at its outer end and a cylindrical bearing surface which is coextensive with the cylindrical bearing surface of the bushing portion of said integral mounting structure when said retaining cap is attached to the stepped end of said bushing portion.

7. The universal lock mount according to claim 1 wherein said lock components include combination lock tumblers and washers, each of said washers having a key for cooperation with said keyway to prevent rotation when supported on said bushing portion.

8. The universal lock mount according to claim 1 wherein said lock components include a lock cam, and a lock link and cam assembly.

9. The universal lock mount according to claim 6 wherein said lock components include a lock cam and link assembly, combination lock tumblers, and washers, each of said washers having a key for cooperation with said keyway to prevent rotation when supported on said bushing portion.

10. In a combination lock assembly for installation in safes and the like, said assembly having a mounting plate for attaching said assembly to a safe, a plurality of tumblers supported on the bearing surface of a cylindrical bushing and separated each from the other by a washer therebetween, and a passageway through said bushing and said mounting plate, the improvement comprising:

said mounting plate and bushing are portions of a unitary resin structure in which said bushing portion has an axial keyway and a step at its outer end, each of said washers having a key which fits into said keyway to prevent washer rotation, a cap fixed to said stepped end of said bushing for retaining said tumblers and washers on said bushing, and a spring biasing said tumblers and washers away from said mounting plate portion and against said retaining cap.

11. The improvement according to claim 10 wherein said unitary resin structure includes a shoulder surrounding said bushing portion and contiguous with said mounting plate portion.

12. The improvement according to claim 11 wherein said spring is a wave washer mounted between said shoulder and one of said washers.

13. The improvement according to claim 10 wherein each of said washers is molded of a resin material and each of said tumblers is zinc coated.

14. The improvement according to claim 10 further comprising a lock link and pin assembly supported on said bushing between said mounting plate and said spring.

15. The improvement according to claim 10 wherein said retaining cap further comprises a cylindrical bearing surface which extends said bearing surface of said bushing when said cap is attached to the stepped outer end of said bushing portion.

16. In a lock assembly for installation as part of a security-type enclosure having an entry way with a movable cover opened by rotation of a spindle which extends through said cover, said lock assembly including components supported on the cylindrical bearing surface of a bushing, a mounting plate for attaching said assembly to the interior surface of said cover, a retainer for holding said components on said bushing, and a passageway through said bushing and said mounting plate for receiving the extended end of said spindle, the improvement wherein:

said mounting plate and said bushing comprise an integrated resin structure with a step at the end of said bushing for receiving said retainer.

17. The improvement according to claim 16 wherein said step includes two orthogonal surfaces and said retainer is fixed to both of said surfaces.

18. The improvement according to claim 16 wherein said bushing further comprises an axial keyway and one of said components includes a key which cooperates with said keyway to prevent rotation of said component.

* * * * *